US006027367A

United States Patent [19]

Woertz et al.

[11] Patent Number: 6,027,367

[45] Date of Patent: Feb. 22, 2000

[54] ELECTRICAL-INSTALLATION SYSTEM

[75] Inventors: Hans Woertz, Basel, Switzerland; Pierre Schoeffel, Blotzheim, France; André Bissig, Aunterschächen, Switzerland; Jürgen Strauss, Schattdorf, Switzerland

[73] Assignee: Dätwyler AG and Woertz AG, Germany

[21] Appl. No.: 08/982,152

[22] Filed: Dec. 1, 1997

Related U.S. Application Data

[63] Continuation of application No. 08/378,432, Jan. 26, 1995, abandoned.

[30] Foreign Application Priority Data

Jan. 31, 1994 [DE] Germany ..... 44 02 837

[51] Int. Cl.[7] ..... H01R 9/07

[52] U.S. Cl. ..... 439/497; 439/416; 174/59

[58] Field of Search ..... 439/409, 416, 439/578, 394, 497; 174/59, 117 F

[56] References Cited

U.S. PATENT DOCUMENTS

| | | | |
|---|---|---|---|
| 3,720,778 | 3/1973 | Woertz et al. . | |
| 3,848,955 | 11/1974 | Lockie et al. | 439/416 |
| 4,365,859 | 12/1982 | Hutter et al. . | |
| 4,508,399 | 4/1985 | Dowling et al. . | |
| 4,758,536 | 7/1988 | Miller et al. . | |
| 4,948,380 | 8/1990 | Dale . | |
| 4,997,388 | 3/1991 | Dale et al. . | |
| 5,059,137 | 10/1991 | Dale et al. . | |
| 5,064,380 | 11/1991 | Dale et al. . | |
| 5,097,099 | 3/1992 | Miller et al. . | |

FOREIGN PATENT DOCUMENTS

| | | |
|---|---|---|
| 1190294 | 7/1985 | Canada . |
| 0550885 A2 | 7/1993 | European Pat. Off. . |
| 1 765 200 | of 1971 | Germany . |
| 2 206 187 | 8/1972 | Germany . |
| 31 33 154 A1 | 3/1982 | Germany . |
| 33 40 943 A1 | 5/1985 | Germany . |
| 85 24 944 | 11/1985 | Germany . |
| 91 04 861 | 7/1991 | Germany . |
| 92 14 675 | 3/1994 | Germany . |
| 3-93173 | 4/1991 | Japan . |
| 5-242918 | 9/1993 | Japan . |

OTHER PUBLICATIONS

Search Report for European Application 94120622.9.

English Translation of Opposition Filed Nov. 2, 1998 for German Patent Application No. P 44 02 837.7–34.

Abstract of German Utility Model 92 14 675 U1.

Translation of Abstract of German Patent Application 17 65 200.

Translation of Abstract of German Patent Application 3340943.

English translation of response of Patent Owner to Opposition before the German Patent Office. Document filed Mar. 24, 1999.

English translation of Office Action for counter–part Japanese patent application 7–31831.

Document containing English translation of Japanese Patent Application 05–242918 published in Patent Abstract of Japan, Section: E, Section No. 1481, vol. 17, No. 698, pp. 145 (Dec. 20, 1993).

*Primary Examiner*—Khiem Nguyen

*Attorney, Agent, or Firm*—Patterson, Belknap. Webb & Tyler LLP

[57] ABSTRACT

An electrical-installation system comprising flat cable and connectors. Power-supply and data-transmission functions are combined in essentially the same plane. The data-transmission wires are not twisted. Contact can be established with the cores inside the connectors by piercing their insulation without stripping it.

18 Claims, 3 Drawing Sheets

ELECTRICAL-INSTALLATION SYSTEM

This application is a continuation of application Ser. No. 08/378,432 filed Jan. 26, 1995, now abandoned.

BACKGROUND OF THE INVENTION

1. Field of the Invention

The present invention concerns an electrical-installation system comprising flat cable and connectors.

2. Description of the Prior Art

All types of data-communications equipment are generally difficult to connect. Various types of cable (data-transmission, power-supply, etc.) must be installed in false ceilings, ducts, shafts, and similar spaces and the equipment attached to the cables.

German AS 2 206 187 (Woertz) discloses flat power-supply cable and an associated connector. The cable essentially comprises several wires extending along the same plane. Contact can be established with the cores inside the connector by piercing their insulation. Although this approach does allow equipment to be simply and rapidly provided with power, the many data-transmission wires still require the extra expenditure of separate installation and connection.

German GM 9 104 861 (Ernst & Engbring) discloses flat cable with several adjacent power-supply wires and a sheaf of twisted wires for transmitting signals and data. The power-supply wires can easily be separated from the sheaf of twisted wires for the purpose of attaching the specific type of conventional plug required tor each. Although this cable does eliminate the expenditure of installing the different types of cable separately the connection process itself remains just as troublesome.

German GM 8 524 944 (Kabelwerke Reinshagen), finally, discloses a data-transmission line combining several coaxial cables and a twisted sheaf into a flat cable. This cable can transmit both high-frequency signals and data between television components for example, although it is hardly appropriate for supplying power. The object of the present invention is to decrease the expenditure of installing and connecting various types of cable.

SUMMARY OF THE INVENTION

This object is attained in accordance with the present invention in a generic flat cable in that it combines power-supply and data-transmission functions in essentially the same plane, whereby the data-transmission wires are not twisted, and in that contact can be established with the cores inside the connector by piercing their insulation without stripping it.

One basic concept of the present invention is combining power-transmission wires and data-transmission wires into a single flat cable such that they can all be connected at once by a single connector with components that pierce their insulation. Instead of having to install and connect two different cables, it is now possible to install only one and to connect it with a single type of connector.

The present invention accordingly exploits the advantages of the power-supply cable disclosed in the aforesaid AS 2 206 187 while extending its range of application to data transmission as well. It has until now been impossible to employ one and the same connector to attach wires with such different characteristics. Power-supply cable generally carries low-frequency high-voltage current and data-transmission cable high-frequency and low-voltage current.

The present invention, in fact, derives from the awareness that effective use of multiple-purpose cable of the type disclosed for example in the aforesaid GM 9 104 861 requires a multiple-purpose connector wherein the power-supply wires cannot be confused with the data-transmission wires at the connection. Furthermore, conventional data-transmission cables comprise several wires that have to be contacted separately, and it is difficult to tell which is which from outside because their position inside the cable is undefined. This is particularly true of twisted wires like those specified in the aforesaid documents. It is impossible to establish a reliable contact just by piercing their insulation. The present invention accordingly also derives from awareness that contact can even be established with hidden data-transmission cores by piercing their insulation if the cores are straight.

Any power-transmission cores next to the data-transmission cores can act as protective or neutral cores. Protective or neutral cores are grounded wires that act like shielding, decreasing the effect on the data-transmission cores of interference from the power-transmission cores. When positioned between data-transmission cores, they also inhibit crosstalk between them. It is particularly preferred for the data-transmission cores to actually be shielded and for the connector to be designed to ensure that the shielding will be pierced when the data-transmission cores are attached. Such shielding will not only protect the data-transmission cores from interference, even from external sources, it will also prevent electromagnetic fields from forming during high-frequency operation. The shielding can enclose all the data-transmission cores together or separately.

The connector in another preferred embodiment of the invention has as many contacts as the cable has cores, and each contact is in particular a screw and has a point that pierces the cable's insulation and, if any, shielding, and establishes contact with a core. Each screw accordingly engages only one cable. It is also of advantage for the contacts that establish contact with the data-transmission cores to be insulated to prevent short circuits between the core and the shielding. The insulation can for example cover the surface of the contact that touches the shielding once the contact has pierced all the way through. When the contacts are screws, the insulation can be a ring surrounding each screw between its point and a threaded section that extends almost to the point. If the surface of the contact is electrically conductive in the vicinity of the shielding, the insulation can separate that area from the point. The point could be mounted insulated on the end of a hollow screw for example and be electrically connected through the inside of the screws. The version of the invention recited in FIG. 6 prevents short circuits by ensuring strict electrical separation between the shielding and core in the data-transmission portion once the outside of the cable, the shielding, and the insulation have been pierced.

It is of advantage for the power-transmission portion to be a three-phase four-wire system with combined neutral and protective cores or more preferably a three-phase five-wire system with separated neutral and protective cores. The cable will accordingly preferably incorporate four and especially preferably five power-transmission cores and at least two data-transmission core.

The cable in one particularly preferred embodiment of the invention fits into an accommodation in the connector such that the cable will always be forced into a specific position therein. This feature practically excludes confusing the data-transmission portion with the power-transmission portion and consequent damage to the computer or other expensive equipment. The extensive prevention of incorrect connections is a particularly effective approach to combining power-transmission and data-transmission cores into a single cable that satisfies the strictest safety standards.

The data-transmission cores are obviously grouped together in a data-transmission portion and the power-transmission cores in a power-transmission portion in another especially preferred embodiment of the present invention, whereby the two portions are connected by a web. It will be of even greater advantage in this event to help prevent inserting the cable into its accommodation in the connector incorrectly for the web not to extend along the middle of the flat of the cable.

Such conventional connectors as plugs are usually attached to the end of a cable, and the connector in accordance with the present invention can basically also be designed fro attachment only to the end of the cable by providing only one opening for its insertion. It is on the other hand particularly practical for the connector to be designed to tap into the cable at any location along it. Such a connector will have one opening for the cable to enter it and another for the cable to exit. Such a feature will allow several pieces of equipment to be connected to one line (and accordingly decentralized distribution of bus intelligence) without having to cut it in two. It also and in particular allows the later attachment of connectors a practically any location along the cable without additional effort or expense. The present invention accordingly represents a considerable simplification.

Another preferred embodiment of the present invention is characterized in that the connector includes power-or-data couplers. These couplers connect with the contacts and allow the attachment of peripherals. In the simplest case they can for example be plug-in, screw-on, or clip-on terminals. It is preferable for the data couplers to comprise busses, transformers, or electrical-to-optical junctions and for the power couplers to comprise relays. When such couplers include electronic, electro-mechanical, and/or optical devices they will especially preferably be accommodated in at least one separate housing that can be fastened to the connector.

BRIEF DESCRIPTION OF THE DRAWINGS

Various embodiments of the present invention will now be specified by way of example with reference to the drawing, wherein.

DESCRIPTION OF THE PREFERRED EMBODIMENT

Parts with similar functions are labeled with the same numbers.

The embodiments illustrated in FIG. 1 will be discussed first.

Figure 1A:
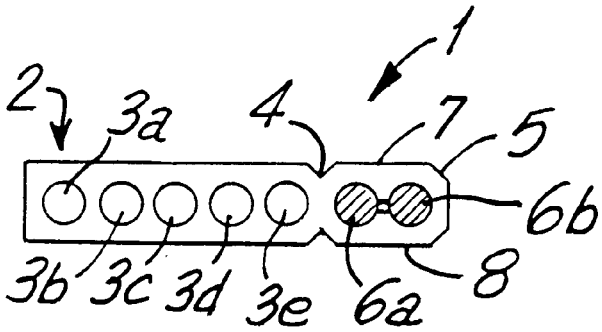
FIGS. 1*a–f* illustrate various types of flat cable.

The flat cable 1 illustrated in FIG. 1*a* comprises two portions, a power-transmission portion 2 and a data-transmission portion 5. Power-transmission portion 2 accommodates five electrically conductive cores 3*a*, 3*b*, 3*c*, 3*d*, and 3*e* that transmit electrical power (e.g. direct current, low-voltage three-phase current, etc.). Data-transmission portion 5. accommodates two straight signal-transmission cores 6*a* and 6*b*. The two portions are connected by a web 4.

The particular practicality of the cross-section of cable 1 will be evident from FIG. 1*a*. Web 4 is comprised of material left over between two wedge-shaped grooves, one on each side 7 and 8 of the cable. The upper and lower edges of the data-transmission portion 5 are beveled. The bevels ensure in conjunction with web 4 that the cable will fit snugly into a matching accommodation in an associated connector as illustrated in FIG. 2.

The structure of combination power-and-data transmission cable 1 will now be specified. Cores 3*a*, 3*b*, 3*c*, 3*d*, and 3*e* are 2.5 $mm^2$. intended for three-phase 380 V, 50 Hz, and 16 A current. Data-transmission cores 6*a* and 6*b* are 1.5 $mm^2$. They are distributed in the sequence polar cores 3*a* through 3*c*, neutral core 3*d*, protective core 3*e*, and data-transmission cores 6*a* and 6*b*.

Figure 1B:
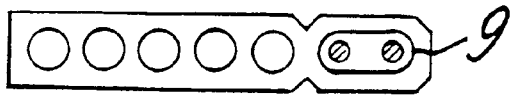
Figure 1C:
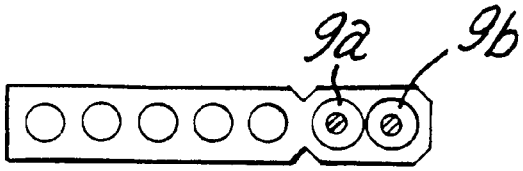

The data-transmission cores 6*a* and 6*b* illustrated in FIG. 1*b* are wrapped together in shielding 9 as further protection from interference. The data-transmission cores 6*a* and 6*b* illustrated in FIG. 1*c* on the other hand are each wrapped in separate shielding 9*a* and 9*b*. A practical shielding material is aluminum-laminated polyethylene terephthalate sheet.

Figure 1D:
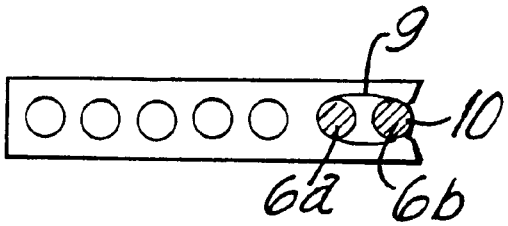

The data-transmission portion 5 in the embodiment illustrated in FIG. 1*d* is not connected to power-transmission portion 2 by a web. The cable's snug fit in the accommodatation inside the connector is ensured in this embodiment by a groove 10 extending along the right side of cable 1.

Figure 1E:
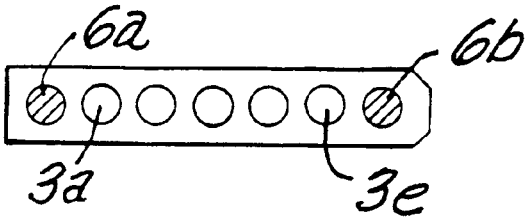

The data-transmission cores 6*a* and 6*b* in the embodiment illustrated in FIG. 1*e* are not adjacent but one on each side of cores 3*a*, 3*b*, 3*c*, 3*d*, and 3*e*. The advantage is that the cores 3*a* and 3*e* next to data-transmission cores 6*a* and 6*b* act as neutral or protective cores. This embodiment has no grooves, and snug, fit is ensured only by bevels at the upper and lower right edges of the cable.

Figure 1F:
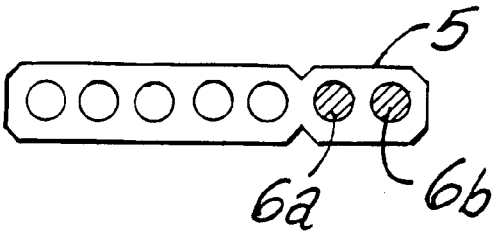

The embodiment illustrated in FIG. 1*f* is essentially similar to the one in FIG. 1*a*. The only difference is that data-transmission portion 5 has rounded edges and the power-transmission portion has beveled edges.

To ensure that contact can be establish when the insulation is pierced the position of every core 3*a*, 3*b*, 3*c*, 3*d*, 3*e*, 6*a*, and 6*b* must be precisely defined. The axis of each core must be located within the cable at a tolerance of ±0.3 mm or less.

Figure 2A:
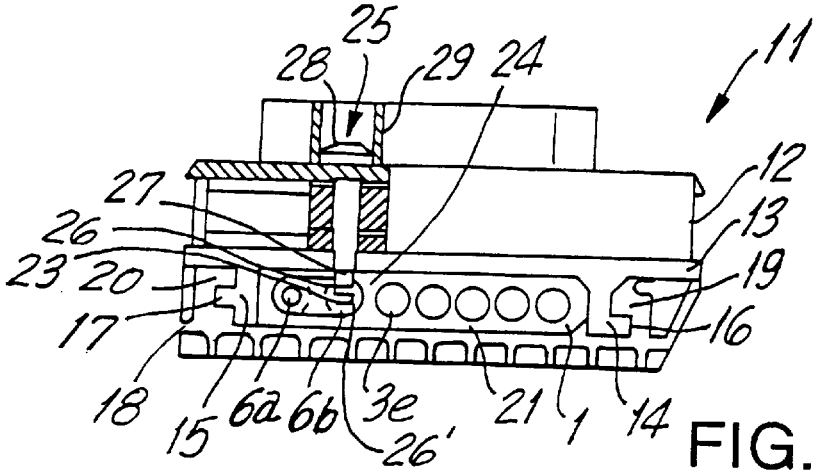
FIG. 2*a* is a section along the line II—II in FIG. 2*b* through one embodiment of a connector with a flat cable inserted into it.

FIG. 2*a* illustrates a connector 11 with a flat cable 1 extending through it. The connector comprises an insulating housing 12 and a base 18. Housing 12 has a longitudinal web 13 and ridges 14 and 15. Ridges 14 and 15 have flanges 16 and 17. Base 18 has matching ridges 19 and 20. Housing 12 fits over base 18 with flanges 16 and 17 engaging ridges 19 and 20.

It will also evident from FIG. 2*a* that the outside of cable 1 fits snugly enough into an accommodation 21 in connector 11 to ensure that it will remain precisely positioned therein.

Figure 2B:
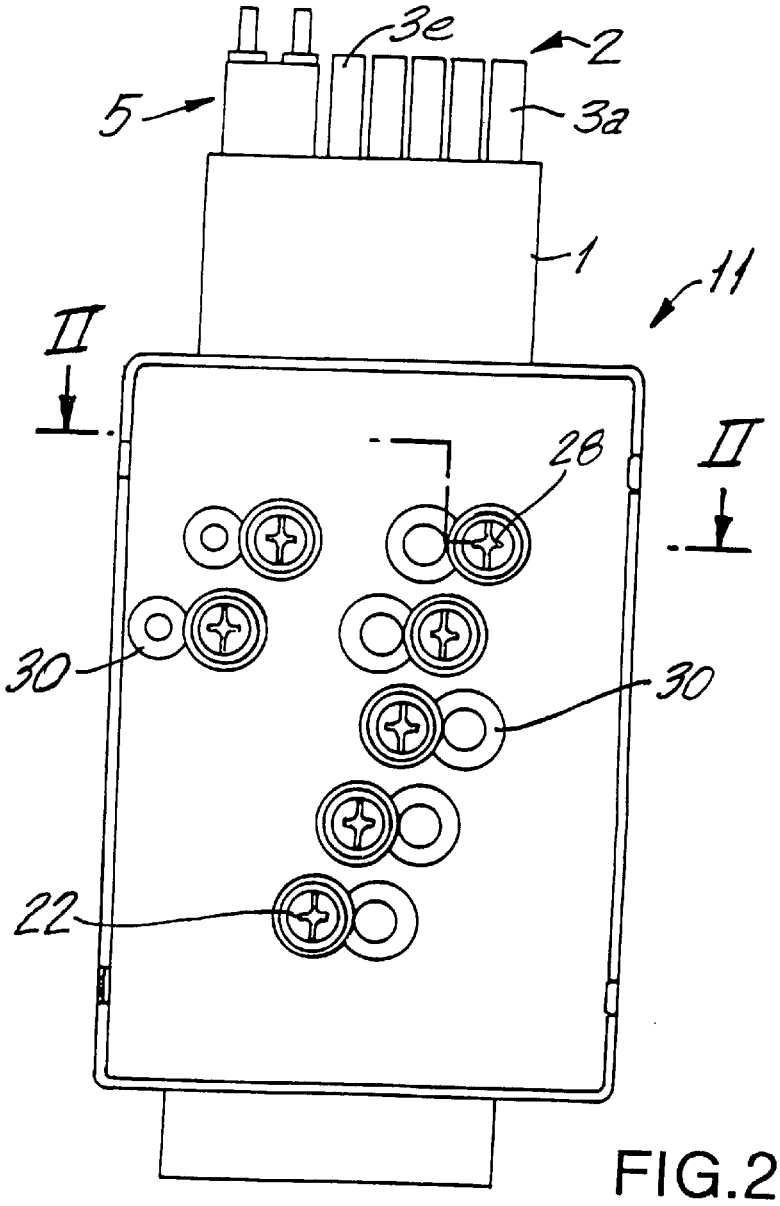
FIG. 2*b* is a top view of the connector illustrated in FIG. 2*a,*

The version of connector 11 illustrated in FIGS. 2*a* and 2*b* has seven terminals 22. Each terminal 22 is associated with a contact in the form of a screw 25. Each screw 25 has a point 23. Points 23 can pierce the cable's insulation 24 and the shielding 9 around data-transmission cores 6*a* and 6*b* and establish contact with cores 3*a*, 3*b*, 3*c*, 3*d*, 3*e*, 6*a*, and 6*b*. The outer surface of the shaft of each screw 25 is also provided with insulation 26 between point 23 and a threaded section 27 to prevent short circuits between data-transmission cores 6*a* and 6*b* and shielding 9. Point 23 extends out of insulation 26 like the point of a needle. The threaded section 27 of screw 25 does not penetrate into the cable. The head 28 of each screw 25 is surrounded by an insulating collar 29. Openings 30 and 30' can accommodate couplings to facilitate the attachment of peripherals.

Screws 25 are mutually displaced along the cable in connector 11 to prevent short circuits and similar drawbacks. Data-transmission connections are definitely separated from power-supply connections.

Figure 3A:
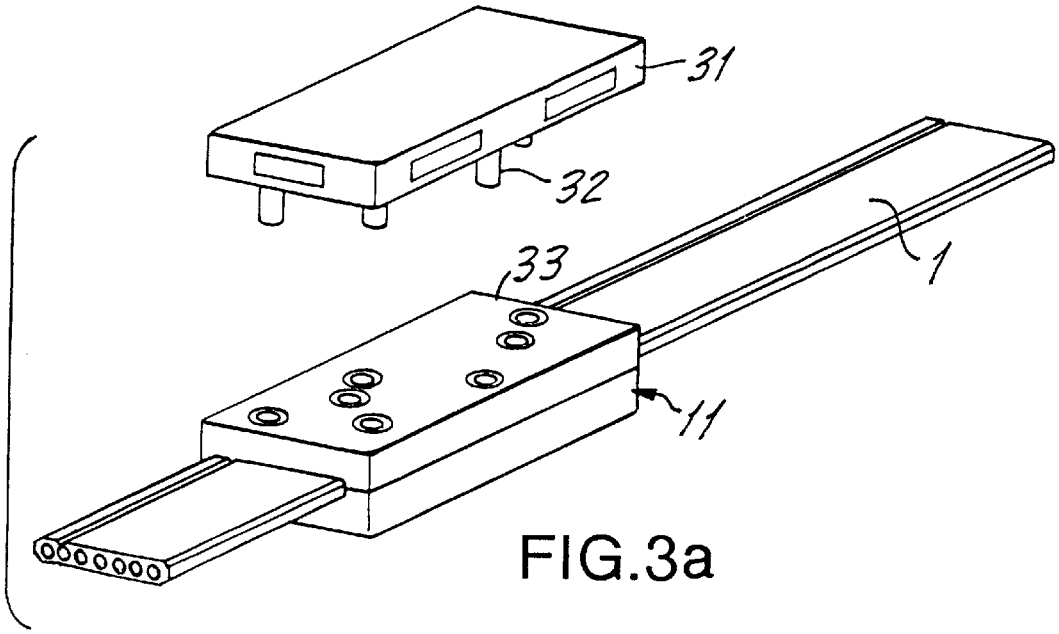
FIG. 3*a* is a perspective view of another connector with a flat cable inserted into it and with a coupler attached from above.
Figure 3B:
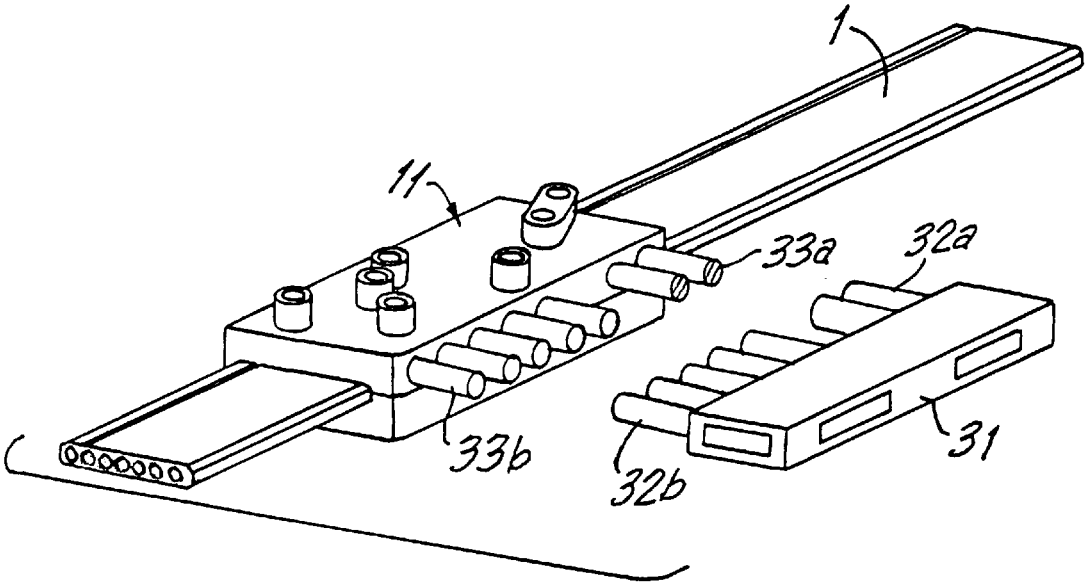
FIG. 3*b* is a view similar to that in FIG. 3*a* but with the coupler attached at one side.

The attachment of one or more peripherals is illustrated in FIGS. 3*a* and 3*b*. A separate housing 31 accommodates transceivers for a data bus and a relay for diverting power for example. Coupling housing 31 can be attached to and detached from connector 11 by plugs 32 on the former that fit into jacks 33 on the latter. Plugs 32 and jacks 33 are positioned above the here unillustrated contact screws in connector 11. The connector 11 illustrated in FIGS. 3*a* and 3*b* differs from the version illustrated in FIG. 2*a* and matches another version of cable 1. The data-transmission cores in this cable extend along the middle of the cable between the power-supply cores. The plugs and jacks are distributed to ensure that housing 31 can be attached to connector 11 in only one precisely defined way. An unillustrated cable extends from housing 31 to the attached peripheral. The version of the housing 31 illustrated in FIG. 3*a* is attached to connector 11 from above (in terms of a horizontal cable). Since their footprints are identical, the two components will constitute an integral block when attached together. The versions of the housing 31 illustrated in FIG. 3*b* on the other hand is attached to connector 11 from the side. Plugs 32 and jacks 33 are distributed along a straight line, although data connection 32*a* and 33*a* is, to prevent confusion, not aligned with power connection 32*b* and 33*b*.

To summarize, the present invention provides a data-usable installation system that requires no insulation stripping and comprises a flat cable and matching connectors. The invention allows both data-transmission and power-supply lines to be connected in a single operation. Installation of the cable in false ceilings, ducts, shafts, and similar spaces is considerably facilitated. The connectors allow branch lines to be connected to main lines without stripping insulation in that they are provided with both data-transmission and power-supply connections that make it possible to provide equipment like computers with both power and signals.

We claim:

1. An electrical-installation system comprising:

a cable comprising at least one insulated power-transmission core and at least two insulated data-transmission cores and shielding enclosing together the at least two data-transmission cores, wherein the at least two data-transmission cores are not twisted with each other and the at least one power-transmission core and the at least two data-transmission cores are combined in essentially the same plane; and a connector comprising at least one insulated contact in engagement with the at least one of the data-transmission cores of the cable by piercing, without stripping, the insulation of the data-transmission core and by piercing, without stripping, the shielding of the data-transmission core.

2. An installation system as in claim 1, whereby any power-transmission core next to a data-transmission core acts as a protective or neutral core.

3. An installation system as in claim 1, whereby the connector includes power-or-data couplers.

4. An installation system as in claim 1, whereby the cable incorporates at least four power-transmission cores.

5. An installation system as in claim 1, wherein the cable fits into an accommodation in the connector such that the cable will always be forced into a specific position therein.

6. An installation system as in claim 1, wherein the at least two data-transmission cores are grouped together in a data-transmission portion and the power-transmission cores in a power-transmission portion; and the cable further comprising a web, the web connecting the data-transmission portion and the power-transmission portion.

7. An installation system as in claim 1, wherein the connector is designed to tap into the cable at any location along it.

8. An installation system as in claim 1, wherein the connector has as many insulated contacts as the cable has data-transmission cores, and each insulated contact is an insulated screw with a point that pierces the cable and establishes contact with a data-transmission core.

9. An installation system as defined in claim 1 wherein the connector also comprises at least one power-connector in engagement with the at least one power-transmission core of the cable, wherein each engaged power-contact is in engagement with only one power-transmission core of the cable by piercing, without stripping, the insulation of the core.

10. An installation system as defined by claim 9 wherein the connector has as many power-connectors as the cable has power-transmission cores, and each power-connector is a screw and has a point that pierces the cable and establishes contact with a power-transmission core.

11. An electrical-installation system comprising:

a cable having an outside and comprising at least one power-transmission core and at least two insulated data-transmission cores and shielding enclosing together at least two of the insulated data-transmission cores; wherein the at least two insulated data-transmission cores are not twisted with each other and the at least one power-transmission core and the at least two data-transmission cores are combined in essentially the same plane; and a connector comprising at least one contact in engagement with the at least one power-transmission core and at least two insulated contacts in engagement with the at least two data-transmission cores of the cable by piercing, without stripping, the outside of the cable and the shielding and insulation of the data-transmission core.

12. An electrical-installation system comprising:

a cable having an outside and comprising at least one insulated power-transmission core, at least two insulated data-transmission cores and shielding of the data-transmission cores against the at least one power-transmission core, wherein the shielding encloses together the at least two data-transmission cores, the at least two data-transmission cores are not twisted with each other and the at least one power-transmission core and the at least two data-transmission cores are combined in essentially the same plane; and a connector comprising at least one power-connector in engagement with the at least one power-transmission core of the cable by piercing without stripping, the outside of the cable and the insulation of the power transmission core;

said connector further comprising, for each of the at least two data-transmission cores, at least one insulated contact in engagement with the corresponding data-transmission core of the cable by piercing, without stripping, the outside of the cable and the shielding and insulation of the data-transmission cores, the insulation of the insulated contacts being such that it prevents short circuits between the pierced data-transmission core and the pierced shielding, wherein the outside of the cable fits into an accommodation in the connector such that the cable will always be precisely forced into a specific position therein, without stripping the outside of the cable and the shielding of the data-transmission cores.

13. The electrical-installation system claimed in claim 12, wherein the cable includes at least four power-transmission cores.

14. The electrical-installation system claimed in claim 12, wherein the at least two data-transmission cores are grouped together in a data-transmission portion and the power-transmission cores in a power-transmission portion; and the cable further comprising a web, the web connecting the data-transmission portion and the power-transmission portion.

15. The electrical-installation system claimed in claim 12, wherein the connector is designed to tap into the cable at any location along it.

16. The electrical-installation system claimed in claim 12, wherein each insulated contact is an insulated screw with a point that pierces the cable and establishes contact with a data-transmission core.

17. The electrical-installation system claimed in claim 12 wherein the connector also comprises at least one power-connector in engagement with the at least one power-transmission core of the cable, wherein each engaged power-contact is in engagement with only one power-transmission core of the cable by piercing, without stripping, the insulation of the core.

18. The electrical-installation system claimed in claim 12 wherein each power-connector is a screw and has a point that pierces the cable and establishes contact with a power-transmission core.

* * * * *